United States Patent [19]

Keiser

[11] 4,227,689

[45] Oct. 14, 1980

[54] EXERCISING DEVICE INCLUDING LINKAGE FOR CONTROL OF MUSCULAR EXERTION REQUIRED THROUGH EXERCISING STROKE

[75] Inventor: Dennis L. Keiser, Sanger, Calif.

[73] Assignee: Kintron, Incorporated, Calif.

[21] Appl. No.: 927,143

[22] Filed: Jul. 24, 1978

[51] Int. Cl.[3] ..... A63B 21/00

[52] U.S. Cl. ..... 272/130; 272/134; 272/DIG. 1; 272/DIG. 4; 272/DIG. 5

[58] Field of Search ..... 272/130, 134, DIG. 4, 272/116, 93, 72, 77, 125, DIG. 1, DIG. 5, 144; 128/25 R

[56] References Cited

U.S. PATENT DOCUMENTS

| | | | |
|---|---|---|---|
| 1,966,848 | 7/1934 | Charters | 272/72 |
| 2,397,054 | 3/1946 | Segalla | 272/72 |
| 2,809,624 | 10/1957 | Becher et al. | 124/77 |
| 3,074,716 | 1/1963 | Mitchel et al. | 272/130 X |
| 3,128,094 | 4/1964 | Wolf | 272/130 |
| 3,387,843 | 6/1968 | Chandler | 272/130 |
| 3,465,592 | 9/1969 | Perrine | 272/125 |
| 3,784,194 | 1/1974 | Perrine | 272/125 |
| 3,822,599 | 7/1974 | Brentham | 272/130 X |

FOREIGN PATENT DOCUMENTS

| | | | |
|---|---|---|---|
| 650009 | 2/1951 | United Kingdom | 272/130 |

*Primary Examiner*—Richard C. Pinkham
*Assistant Examiner*—William R. Browne
*Attorney, Agent, or Firm*—Huebner & Worrel

[57] ABSTRACT

An exercising device having an exercising member, an assembly mounting the member for movement along a curved path of travel, a pneumatic system operable to provide a force resisting movement of the member, a linkage interconnecting the pneumatic system and the member and having a pair of pivot points adjacent to said member, and a stop borne by the member and engageable with the linkage during movement of the member discriminately to control the pivot point about which relative movement between the linkage and member is accommodated to control the force required to operate said pneumatic system.

11 Claims, 5 Drawing Figures

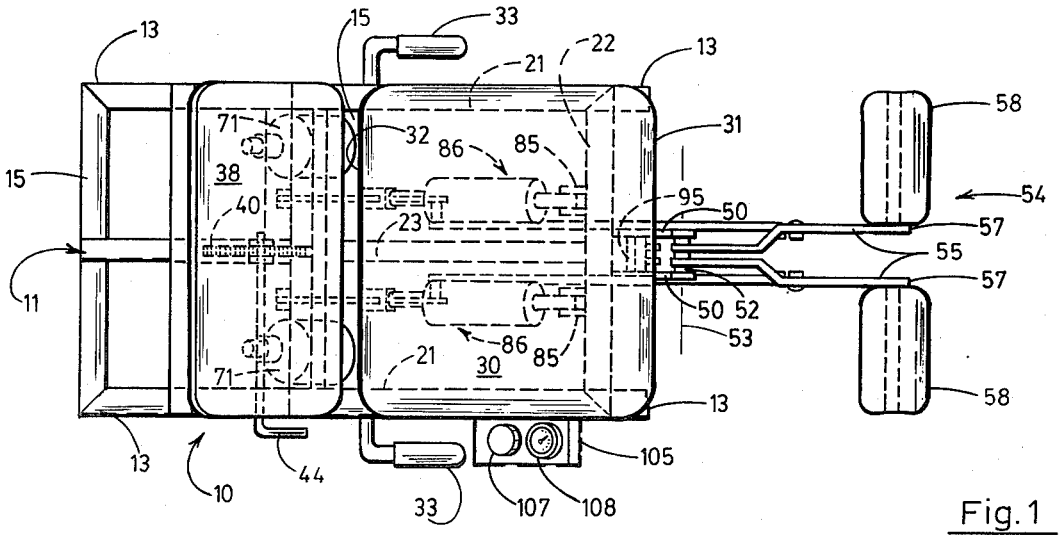
Fig. 1
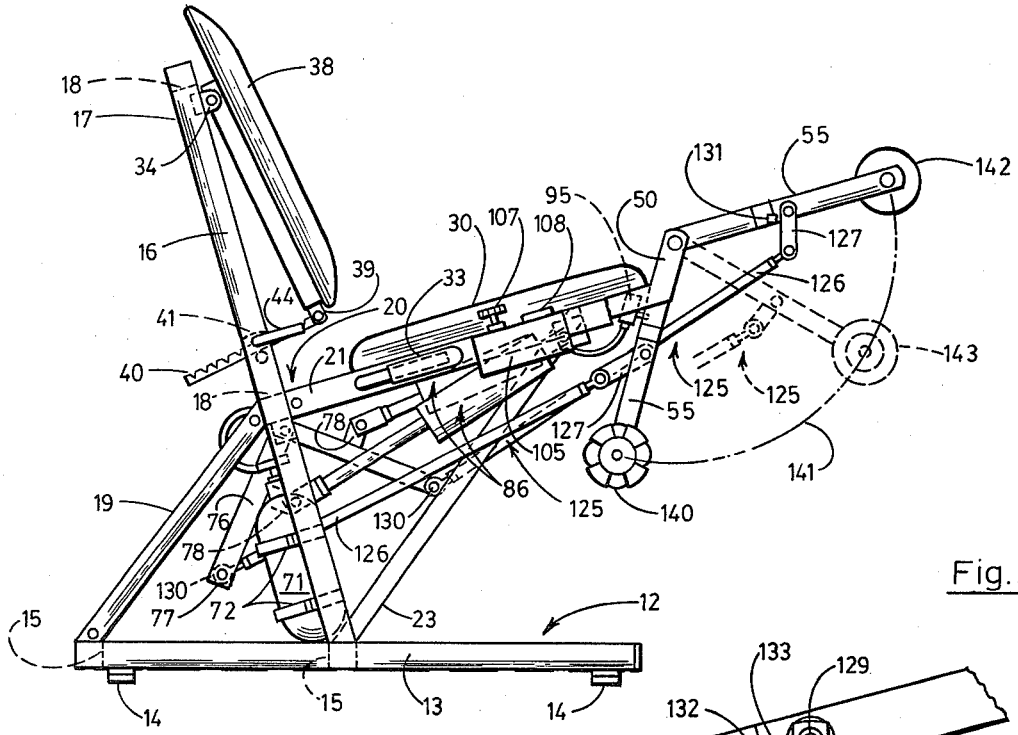
Fig. 2
Fig. 3

EXERCISING DEVICE INCLUDING LINKAGE FOR CONTROL OF MUSCULAR EXERTION REQUIRED THROUGH EXERCISING STROKE

BACKGROUND OF THE INVENTION

1. Field of the Invention

The present invention relates to an exercising device and more particularly to such a device operable for leg exercise which minimizes variation in the muscular force required through an exercising stroke and which eliminates those hazards encountered in the use of prior art exercising device which create a risk of strain and injury to the operator.

2. Description of the Prior Art

Pursuant to 37 C.F.R. 1.97 and 1.98 and the Rules Of Practice In Patent Cases, the applicant hereby makes of record the following prior art patents, copies of which are enclosed:

| | | |
|---|---|---|
| 1,966,848 | Charters | July 17, 1934 |
| 2,397,054 | Segalla | Mar. 19, 1946 |
| 650,009 | Galleret | Feb. 7, 1951 |
| 2,809,624 | Becher et al. | Oct. 15, 1957 |
| 3,128,094 | Wolf | Apr. 7, 1964 |
| 3,387,843 | Chandler | June 11, 1968 |
| 3,465,592 | Perrine | Sept. 9, 1969 |
| 3,784,194 | Perrine | Jan. 8, 1974 |

In addition the applicant wishes to make of record the attached copies of two photographs showing exercising devices representing the closest such devices currently on the market to the applicant's invention insofar as the applicant is aware.

The Charters U.S. Pat. No. 1,966,848 discloses a combined exercising and amusement device.

The Segalla U.S. Pat. No. 2,397,054 discloses an exercising apparatus.

The Galleret U.S. Pat. No. 650,009 discloses a physical culture apparatus using an hydraulic cylinder.

The Becher et al. U.S. Pat. No. 2,809,624 discloses a missile firing trainer device using a compressed gas cylinder.

The Wolf U.S. Pat. No. 3,128,094 discloses an exerciser with hydraulically interconnected chinning bar and foot support.

The Chandler U.S. Pat. No. 3,387,843 discloses an exercise machine in which the user pushes or pulls against a resisting force produced by a pnuematic cylinder operating in conjunction with compressed air.

The Perrine U.S. Pat. No. 3,465,592 discloses an isokinetic exercise process and apparatus operable for leg exercise.

The Perrine U.S. Pat. No. 3,784,194 shows a bilateral reciprocal isokinetic exerciser operable for leg exercise.

The copies of two photographs attached hereto reveal leg exercising machines currently on the market which utilize stacks of weights as the resistance force.

Commercially available exercising devices possess certain characteristics of operation which create a risk of injury to the operator and which prevent realization of the optimum muscular exertion for a given period of use. Nearly all commercial exercising devices, whether for use in leg exercises or otherwise, employ a stack of weights as the resistance force. Typically the operator selects the number of weights to be lifted and then operates the device by exerting force against a movable member to lift the number of weights selected. Because of the inertia of rest of the weight stack, initial movement can be achieved only by exerting considerably more muscular force than the average of the forces exerted throughout the exercising stroke. However, once movement of the weight stack has been initiated, inertia of motion greatly reduces the amount of force which must be applied to continue movement of the weight stack through the stroke. Similarly, if the operator moves quickly enough, the return stroke of the exercising member can be accomplished with little or no resistance force due to inertia causing the weight stack to lag behind movement of the exercising member. While the average of the forces exerted against the exercising member throughout the stroke may be approximately that most suited to the exercising operation desired, the actual force exerted at any given point along the stroke is most commonly either substantially greater or substantially less than the optimum.

The problems encountered in such prior art devices are particularly acute where leg exercisers are concerned. Leg exercises are, of course, undertaken to develop or to maintain development of leg muscles and particularly those of the thigh. Four muscles located on the front and sides of the thigh known as the rectus femoris, vastus lateralis, vastus medialis, and vastus intermedius form a muscle group which is normally the subject of development exercises. However, it is well known that serious injury can occur in the ligaments and tendons of the knee area in exercises of this type. Unfortunately, prior art exercising devices tend to create strain on these structures of the knee during exercise of the thigh muscles. Not only does the uneven requirement of muscular exertion during an exercising stroke produce strain in the knee, but such devices in themselves appear to create a significant portion of the stress in the knee area rather than in the muscles which are the subject of the exercising activity. Furthermore, where the weight stack lags behind movement of the exercising member to the start position, an extremely dangerous situation is presented. If the operator exerts force to slow the return of the exercising member so that the weight stack catches up with the member, sudden and severe strain can be placed on muscles, tendons and ligaments. This risk of injury is intolerable in hospital environments were the devices are used for therapeutic purposes such as after knee surgery.

Therefore, it has long been known that it would be desirable to have an exercising device which requires the exertion of relatively uniform muscular force throughout an exercising stroke so as to obtain optimum benefit from a given period of exercise, which reduces to an absolute minimum the risk of injury using such an exercising device, and which places the burden of the exercising activity on those muscles which are the target rather than placing strain on tendons, ligaments or other connective tissue.

SUMMARY OF THE INVENTION

Therefore, it is an object of the present invention to provide an improved exercising device.

Another object is to provide such a device which minimizes the risk of injury to an operator.

Another object is to provide such a device which is particularly well suited to the therapeutic development of leg muscles permitting a doctor or trainer to select the optimum resistance force for exercising as part of a program of development wherein muscular force must be applied both on the extension and return strokes.

Another object is to provide such an exercising device which does not require the operator to overcome inertia of rest in beginning an exercising stroke, but which requires even and continued exertion of muscular force throughout the exercising stroke.

Another object is to provide such an exercising device which has particular utility in exercising the rectus femoris, vastus lateralis, vastus medialis and vastus intermedius muscles of the thigh while avoiding stress upon the ligaments and tendons associated with the knee.

Another object is to provide such an exercising device which possesses a linkage operable toward the end of the extension stroke to require continued muscular exertion through the end of the stroke.

Another object is to provide such an exercising device which is not subject to the hazard of placing sudden and severe strain on the thigh and knee areas of the leg as encountered in exercising devices using a weight stack.

Another object is to provide such a device which affords an adjustable pneumatic resistance force in a device permitting the exercise of leg muscles.

Further objects and advantages are to provide improved elements and arrangements thereof in an apparatus for the purposes described which is dependable, economical, durable and fully effective in accomplishing its intended purposes.

BRIEF DESCRIPTION OF THE DRAWINGS

FIG. 1 is a top plan view of the exercising device of the present invention with the exercising members thereof shown in fully extended positions.

FIG. 2 is a side elevation of the exercising device showing its pair of exercising members in the fully extended and retracted positions and an exercising member in phantom lines at the approximate position at which operation of the linkage thereof is initiated.

FIG. 3 is a somewhat enlarged fragmentary view showing the linkage of one of the exercising members.

DESCRIPTION OF THE PREFERRED EMBODIMENT

Figure 4:
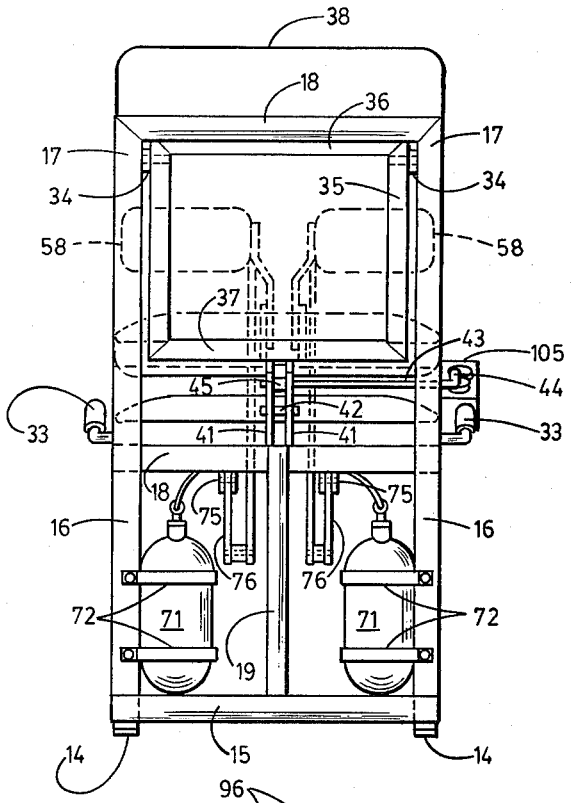
FIG. 4 is a rear elevation of the exercising device with the exercising members shown in fully extended positions.

Referring more particularly to the drawings, the exercising device of the present invention is generally indicated by the numeral 10. The device has a frame 11 having a base 12. The base is composed of a pair of parallel members 13 individually mounting resting pads 14 disposed for engagement with a supporting surface, such as a floor, not shown. The parallel members 13 are interconnected by a pair of cross members 15 to form the base.

The frame 11 has a pair of parallel upright members 16 secured on the parallel members 13 in substantial alignment with the central cross member 15 and extending upwardly and rearwardly therefrom to upper end portions 17, as best shown in FIG. 2. A pair of cross members 18 are mounted on and interconnect the upright members in spaced substantially parallel relation, as best shown in FIG. 4. A rear brace member 19 is affixed on and interconnects the cross member 15 on the left, as viewed in FIG. 2, and the central cross member 18. A support or seat frame 20 is fastened on the upright member 16 in alignment with the central cross member 18 and extending at substantially right angles to the upright members. Preferably the seat frame is disposed at an angle of approximately fifteen degrees with respect to true horizontal. The seat frame has a pair of parallel members 21 individually borne by the upright members and extending in substantially parallel relation upwardly and forwardly, as best shown in FIG. 2. The remote ends of the parallel members mount a cross member 22 extending in right-angular relation therebetween. A front brace member 23 is secured on the central cross member 15 and extends upwardly and is fastened at its remote end on the cross member 22 of the seat frame. Thus, the frame 11 of the exercising device 10 is structurally rigid and of sufficient strength to support the operable components of the device as well as an operator.

A support or seat 30 is mounted on the seat frame 20. The seat has a front edge 31 extending forwardly of the cross member 22 and a rear edge 32. As can best be seen in FIG. 2, the seat cushion is of relatively low profile. A pair of hand grips 33 are individually secured on the parallel members 21 of the seat frame 20 on opposite sides of the rear edge 32 of the seat. A pair of pivot mounts 34 are individually affixed on the upper end portions 17 of the upright members 16. A seat back frame 35 is pivotally mounted on the mounts 34. The frame has an upper portion 36 which is mounted on the mounts 34 and a remote lower portion 37. A seat back or cushion 38 is borne by the back frame 35. A pivotal connection 39 is affixed on the lower portion of the seat back frame substantially centrally thereof. A ratchet bar 40 is pivotally mounted on the connection 39.

A pair of plates 41 are secured, as by welding, on the central cross member 18 substantially centrally thereof disposed in spaced substantially parallel upstanding relation. A cross-piece 42 interconnects the plates and supports the ratchet bar 40 for slidable movement therealong between the plates 41. An arm 43 is rotationally extended through the plates 41 in closely spaced relation to the cross piece 42 and extends laterally to the right, as viewed in FIG. 4, to mount a handle 44 on the remote end thereof. A pawl 45 is borne by the arm between the plates for pivotal movement therewith to and from engagement with the ratchet bar for selective retention of the lower portion 37 of the seat back frame in the desired position.

A pair of mounting brackets 50 are secured as by welding on the cross member 22 adjacent to the front edge 31 of the seat 30 extending in spaced substantially parallel relation forwardly and upwardly to remote upper ends 51. A shaft 52 is mounted on and interconnects the upper ends 51 of the brackets defining an axis of rotation 53 substantially parallel to the front edge 31 of the seat and a short distance thereabove. A pair of exercising members 54 are rotationally mounted on the shaft 52. Each of the exercising members has an arm 55 mounting a bearing 56 rotationally received on the shaft. Each arm has an outer portion 57 mounting a cushioned roller 58 extending laterally of the arm, as best shown in FIG. 1.

Figure 5:
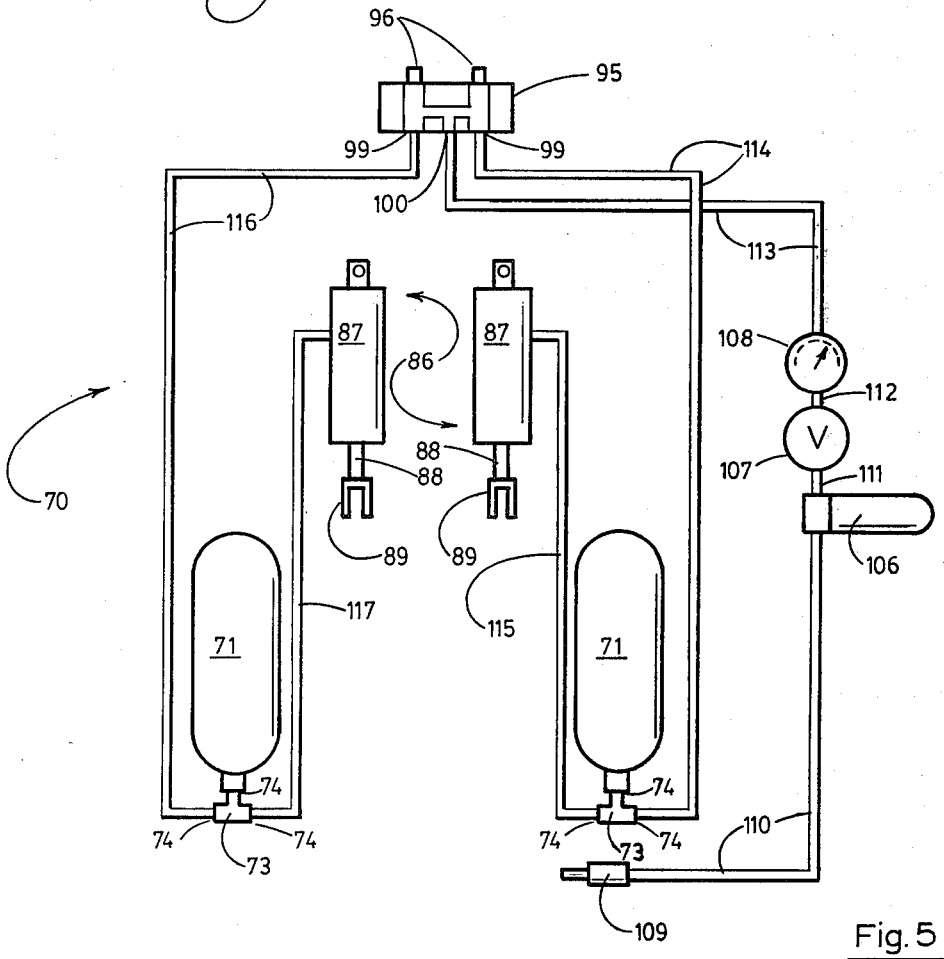
FIG. 5 is a schematic diagram of the pnuematic system of the exercising device.

The exercising device 10 has a pnuematic system 70 shown schematically in FIG. 5. The pneumatic system has a pair of air reservoirs 71 of predetermined internal volume. Each of the reservoirs is mounted on one of the upright members 16 by a pair of mounting brackets 72 borne by each upright member, as best shown in FIG. 4. Each of the air reservoirs has an air coupling 73 at one end thereof communicating with the interior of the reservoir in airtight relation. Each coupling is of the T-type having three connections 74 one of which communicates with the interior of the reservoir.

A pair of pivot mounts 75 are affixed, as by welding on the central cross member 18 of the frame 11 in predetermined spaced relation, as can best be seen in FIG. 4. A pair of lever arms 76 are individually pivotally fastened on the pivot mounts for individual movement about a common axis of rotation extending substantially parallel to the central cross member 18. The lever arms have corresponding remote ends 77. The lever arms individually mount connection plates 78 substantially midway between their remote ends and the pivot mounts and extending in the general direction of the exercising members 54.

A pair of mounting assemblies 85 are individually secured, as by welding, on the cross member 22 of the seat frame 20 in spaced relation and individually facing generally in the direction of the lever arms 76. A pair of pneumatic rams 86 are individually pivotally affixed on the mounting assemblies. Each of the rams has a cylinder portion 87 attached to the mounting assembly and an arm portion 88 received for slidable movement within the cylinder in the conventional manner and having a piston, not shown, borne by the arm and movable within the cylinder. Each arm portion has a mount 89 at the remote end thereof which is pivotally fastened on the connection plate 78 of its respective lever arm 76.

A pair of normaly closed pneumatic valves 95 of unitary construction are mounted on and extend between the mounting brackets 50 in the position shown in FIGS. 1, 2 and 3. The valves mount a pair of plungers 96 which are individually operable by engagement by the exercising members with which they are aligned, as will hereinafter be described. Each plunger has an extended or closed position 97 as shown in phantom lines in FIG. 3. Each plunger also has a depressed or open position 98 as shown in full lines in FIG. 3. The valves mount a pair of outlet hose connections 99 on opposite sides of an inlet hose connection 100. It will be understood that when a plunger is extended, the valve is closed so that no air can pass from the inlet connection through that portion of the valve and out the adjacent outlet connection. Conversely, when the plunger is depressed, the valve is open so as to permit the passage of air therethrough between these connections.

A control console 105 is mounted on the parallel member 21 of the seat frame 20, as shown in FIGS. 1 and 2. The control console contains an air filter 106, a pressure regulator 107, and a pressure gauge 108. The pressure regulator 107 operates in the conventional fashion to adjust the amount of air pressure released into the pneumatic system as registered by the pressure gauge 108. The air filter simply operates to filter air prior to passage into the pressure regulator. The pneumatic system 70 further includes an air connection 109 adapted to be secured in air transferring relation to a source of air or another suitable gas under pressure.

Referring more specifically to FIG. 5, the pneumatic system 70 has a pneumatic conduit 110 which interconnects air connection 109 and the air filter 106. A pneumatic conduit 111 operatively interconnects the air filter and the pressure regulator 107. A pneumatic conduit 112 interconnects pressure regulator 107 and the pressure gauge 108. A pneumatic conduit 113 interconnects the pressure gauge and the inlet hose connection 100 of the pair of normally closed pneumatic valves 95. A pneumatic conduit 114 operatively interconnects the outlet hose connection 99 on the right, as viewed in FIG. 5, and one of the connections 74 of air coupling 73 of the air reservoir 71 on the right as viewed in FIG. 5. A pneumatic conduit 115 interconnects the other available connection 74 of the same air reservoir and the cylinder portion 87 of the pneumatic ram 86 on the right in FIG. 5 at a postion adjacent to the mounting assembly 85 thereof. A pneumatic conduit 116 operatively interconnects the outlet hose connection 99 on the left, as viewed in FIG. 5, and one of the connections 74 of air coupling 73 of the air reservoir 71 on the left. A pneumatic conduit 117 interconnects the other available connection 74 of the same air reservoir and the cylinder portion 87 of the other pneumatic ram 86, as shown in FIG. 5.

A pair of control linkages 125 invidually interconnect the exercising members 54 and their respective lever arms 76. Each control linkage is composed of a first portion or link 126 interconnected with a second portion or link 127. The first and second links are interconnected by a first pivotal connection 128 which constitutes a first pivot point. A second pivotal connection 129 which constitutes a second pivot point interconnects the second link and its respective exercising member 54 substantially centrally thereof. A third pivotal connection 130 which constitutes a third pivot point interconnects the free end of the first link 126 and the connection plate 78 of its respective lever arm 76. A stop assembly 131 is mounted on each exercising member in closely spaced relation to the second pivotal connection 129 for engagement by the second link 127. The stop assembly is composed of an internally screw threaded sleeve 132 secured, as by welding, on the exercising member and having a screw threaded stop 133 screw threadably adjustably received within the sleeve. As can best be seen in FIG. 3, inward and outward adjustment of the stop 133 within the sleeve adjusts the point at which the second link engages the stop.

Referring more particularly to FIG. 2, each of the exercising members 54 is adapted to be moved from a start position indicated at 140 in which the exercising member engages and depresses its respective plunger 96. The roller 58 of the exercising member is adapted to be carried with movement of the member along an arcuate path of travel 141 to an extended position 142. The extended position shown in FIG. 2 is not necessarily all of the upward movement permitted by the exercising device, but rather intended to indicate the point of maximum upward movement which can be achieved by the leg of an operator seated on the device.

A midway position 143 is shown in phantom lines in FIG. 2. This position is intended to indicate approximately the point at which the second link 127 of an exercising member is first brought into contact with the stop 133. At the moment such engagement occurs, the second link is prevented from moving pivotally further relative to its exercising member and is thus fixed with respect to the member. Consequently, pivotal movement to accommodate further upward movement of the exercising member thereafter occurs about the first pivotal connection 128. Thus, in a normal exercising stroke the linkage 125 of each exercising member remains relatively straight during movement from the start position along the arcuate path of travel. Relative movement between the linkage and the exercising member is accommodated about the second pivotal connection 129 until the second link is brought into contact with the stop by continued movement of the exercising member. As noted, this occurs when the exercising member reaches the midway position 143 which is approximately seventy-five degrees from the start position about the arcuate path of travel. The moment this occurs, pivotal movement between the exercising member and the linkage is discontinued about the second pivotal connection 129 and begins about the first pivotal connection 128.

The purpose for this operation is to reduce the leverage in the latter portion of the exercising stroke achievable through the linkage moving about the first pivotal connection. The linkage operates smoothly and effectively to reduce the decline in the magnitude of the muscular force required for movement of the exercising member. In otherwords, the linkage operates to maintain relatively constant the amount of force required for movement of the exercising member throughout the stroke avoiding the variations of great amplitude encountered in prior art exercising devices.

OPERATION

The operation of the described embodiment of the subject invention is believed to be clearly apparent and is briefly summarized at this point. After having adjusted the seat back 38 to the angle desired using the arm 43, the operator seats himself on seat 30 resting against the seat back 38. His legs are disposed on opposite sides of the exercising members 54 with feet positioned under the cushioned rollers 58 thereof. At this point both exercising members are in the start positions 140. The operator then adjusts the pressure regulator 107 until the pressure gauge 108 indicates the desired resistance pressure indicated in pounds per square inch. It has been found that the optimum range of adjustment to be afforded by the exercising device is from two to eighty-five pounds per square inch. However, the device can be constructed to provide a greater range if desired. In any event, the operator selects a resistance force most suitable for him. The operator will, of course, determine the appropriate resistance force through use of the device.

Once the desired pressure has been selected, the operator grips the hand grips 33 to help maintain his position and then extends his legs in the exercising strokes to carry the rollers 58 along the paths of travel 141. The exercising device permits each exercising member to be moved independently of the other without in any way affecting their respective resistance forces. Thus, the legs of the operator can be moved alternately in reciprocal strokes, or in unison, or simply one leg at a time as the operator prefers.

Movement of an exercising member by the leg causes the linkage 125 to pivot its respective lever arm 76 about pivot mount 75. This causes the arm portion 88 of its respective pneumatic ram 86 to be forced into the cylinder portion 87 thereof. For example, in the case of the ram on the left in FIG. 5, such movement causes the piston, not shown, to compress air within the cylinder portion 87, pneumatic conduit 117, air reservoir 71, and pneumatic conduit 116. The purpose for the air reservoir is to provide sufficient volume in the pneumatic system for compression by movement of the exercising member. Thus, the greatest volume of air pressurized is within the reservoir 71. Since the pneumatic valves 95 are closed except when the exercising member engages its respective plunger 96, the initiation of movement of the exercising member causes the valve to close as a result of movement of the member from the plunger. Thus, continued movement of the exercising member compresses air within the system back to the pneumatic valve, but not therebeyond.

When the exercising member reaches the midway position 143, the second link 127 is brought into engagement with the stop 133 so as to cause pivotal movement to begin about the first pivotal connection 128 rather than about the second pivotal connection 129. This reduces the leverage appliable by the operator during the balance of the exercising stroke so as to require a relatively constant force to be exerted in moving the exercising member.

The operator normally continues movement of the roller 58 along the path of travel 141 until the extended position 142 is reached. However, the device permits movement along any portion of the path of travel desired. During return to the start position 140, the operator must continue to work against the force of the compressed air within the system since the member is still subject to this pressure. Thus, the operator is required to exert muscular force in both directions along the path of travel. It has been found that this permits the operator, based upon the pressure regulator setting, to exercise to maximum benefit for a given period of exercise.

Since no weight stack is used and since pressure on the exercising member is constant, there is no danger of a sudden and injurious increase in the force on the member. Furthermore, the operator is protected from having the pressure within the system inadvertently increased since the normally closed valves 95 prevent the further admission of air into the system until the exercising member is again returned to the start position 140. Upon return to the start position, depression of the plunger opens the air valve and permits the air to flow under pressure through the system and into the pneumatic valves through the inlet hose connection 100. This permits the system to replenish any air lost during any exercising strokes so as to maintain the resistance force selected by adjustment of the pressure regulator 107. It has also been found that, unlike prior art devices, the exertion of muscular force required in the use of each exercising member takes place within precisely those muscles where it is desired rather than putting strain on ligaments and tendons in the knee area of the leg. It is believed that this results from a combination of factors including the angle of the seat, a seat of minimal thickness, the use of a seat back, the position of the roller in the start position relative to the seat and the use of a pneumatic resistance force. Yet, the continued movement of the leg causes beneficial exercising of the knee muscles without risk of injury.

Therefore, the exercising device of the present invention permits an operator to obtain the optimum exercising benefits for a given period of operation while minimizing the risk of strain and serious injury during such use in a device which possesses a broad range of adjustment, a flexibility of use and a compact and dependable construction not found in prior art devices.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desired to secure by Letters Patent of the United States is:

1. An exercising device comprising an exercising member, means mounting said member for movement in a substantially arcuate path, means for resisting said movement, a linkage interconnecting the resisting means and the member for operation of said resisting means upon movement of the member and composed of first and second portions interconnected for pivotal movement about a first pivot point and said second portion connected to the member for pivotal movement about a second pivot point, and a stop borne by said member and engageable by the second portion when the member reaches a predetermined position in said path to fix the second portion relative to the member to cause pivotal movement about the first pivot point during continued movement of the member in the path beyond said predetermined position.

2. The exercising device of claim 1 wherein the resisting means has a reservoir containing a gas compressible by the resisting means during movement of the member in said path.

3. An exercising device comprising a support for an operator having predetermined forward and rearward edges and the forward edge being elevated relative to the rearward edge; a member, having a remote end, borne by the device for movement in reciprocal exercising strokes, upon the application of force against said remote end, substantially about an axis disposed in proximity to the forward edge of the support from a start position in which said remote end is beneath said forward edge and nearer to the rearward edge of the support than the axis is from the rearward edge; and pneumatic means for resisting movement of the member including a linkage operatively connected to said member and having a first pivot point spaced from the member and a second pivot point adjacent to the member, and pivot control means borne by the member to cause relative movement between the linkage and the member during an exercising stroke to be about said second pivot point during the portion of the stroke nearest the start position and to be about the first pivot point during a predetermined portion of the stroke remote from the start position.

4. The device of claim 3 wherein the linkage has a first portion extending between the resisting means and the first pivot point and a second portion extending between the first and second pivot points and said pivot control means includes a stop borne by the member in position for engagement by the second portion during said predetermined portion of the stroke to fix the second portion relative to the member and cause relative movement about the first pivot point.

5. The device of claim 4 wherein said stop is mounted on the member at a position for engagement by said second portion at a point approximately 75° from said start position about the axis.

6. An exercising device comprising a support for an operator having predetermined forward and rearward edges and the forward edge being elevated relative to the rearward edge; a member, having a remote end, borne by the device for movement in reciprocal exercising strokes, upon the application of force against said remote end, substantially about an axis disposed in proximity to the forward edge of the support from a start position in which said remote end is beneath said forward edge and nearer to the rearward edge of the support than the axis is from the rearward edge; and pneumatic means for resisting movement of the member including a source of air under pressure, a normally closed valve engaged by said member in the start position to open, a reservoir and a conduit system interconnecting the source, valve and reservoir in series relation whereby the reservoir receives a volume of air under pressure from the source through the conduit system and valve when said member is in the start position and said volume is compressed within the reservoir during the exercising strokes to resist movement of the member.

7. A leg exercising device comprising a support for an operator, a member having a portion to receive the application of muscular force thereagainst, means mounting the member in proximity to the support with said portion disposed to receive said muscular force exerted by a leg of an operator for reciprocal movement along a curved path of travel from and for return to a start position substantially about an axis of rotation, a stop borne by the member in a predetermined position, and means for pneumatically resisting movement of the member along said path of travel in response to said application of muscular force including a linkage composed of first and second links pivotally interconnected at a first pivot point and the second link connected to the member for pivotal movement about a second pivot point wherein relative movement between the member and the linkage is accommodated by pivotal movement about the second pivot point until the second link engages the stop and thereafter said relative movement is accommodated by pivotal movement about the first pivot point to reduce the rate of reduction in the amount of muscular force required for movement of the member along the portion of said path remote from the start position.

8. The leg exercising device of claim 7 wherein the length of said second link and thus the distance between said first and second pivot points is not greater than the distance between the second pivot point and the point of intersection of a line of reference extending from said axis of rotation to the linkage in right-angular relation to said linkage at the time said second linkage engages the stop.

9. An exercising device comprising an exercising member; means mounting the member for movement along a substantially curved path of travel; means for resisting movement of the member along said path of travel; a linkage, having a pair of links, interconnecting the resisting means and the member and having a pair of pivot points permitting individual pivotal movement thereabout during said movement of the member along the path of travel; and means for locking one of said links relative to the member at a predetermined position of the member in the path of travel to prevent pivotal movement about one of the pivot points of said pair while permitting pivotal movement about the other pivot point of said pair to control the muscular force required for continued movement of the member along the path of travel beyond said predetermined position.

10. The exercising device of claim 9 wherein said locking means includes a stop mounted on the device for engagement between said link and the member when the member reaches said predetermined position in the path of travel.

11. An exercising device comprising an exercising member; means mounting the member for movement along a substantially curved path of travel in reciprocal exercising strokes from and to a start position; means for resisting movement of the member along said path of travel; a linkage operatively interconnecting the member and the resisting means and having a first pivot point spaced from the member and a second pivot point adjacent to the member; and pivot control means borne by the exercising device for causing relative movement between the linkage and the member during an exercising stroke to be about the second pivot point during the portion of the stroke nearest the start position and to be about the first pivot point during a predetermined portion of the stroke remote from the start position.

* * * * *

UNITED STATES PATENT AND TRADEMARK OFFICE

CERTIFICATE OF CORRECTION

PATENT NO. : 4,227,689

DATED : October 14, 1980

INVENTOR(S) : Dennis L. Keiser

It is certified that error appears in the above-identified patent and that said Letters Patent are hereby corrected as shown below:

Kindly delete the name of the assignee "Kintron, Incorporated", and substitute ---KEISER CORPORATION---.

Signed and Sealed this

*Twenty-fourth* Day of *February 1981*

[SEAL]

*Attest:*

RENE D. TEGTMEYER

*Attesting Officer*

*Acting Commissioner of Patents and Trademarks*